US005490444A

United States Patent [19]

Claas

[11] Patent Number: 5,490,444

[45] Date of Patent: Feb. 13, 1996

[54] PISTON PUMP WITH IMPROVED HOLD-DOWN MECHANISM

[75] Inventor: Anthony M. Claas, Waukesha, Wis.

[73] Assignee: Dynex/Rivett, Inc., Pewaukee, Wis.

[21] Appl. No.: 317,213

[22] Filed: Oct. 3, 1994

[51] Int. Cl.[6] ..... F01B 3/00; F01B 13/04; F04B 1/12

[52] U.S. Cl. ..... 92/71; 91/499; 417/269

[58] Field of Search ..... 92/71, 70; 91/490, 91/499; 417/269, 222.1, 222.2, 554

[56] References Cited

U.S. PATENT DOCUMENTS

| | | | |
|---|---|---|---|
| 2,445,281 | 7/1948 | Rystrom . | |
| 2,612,837 | 10/1952 | Midgette . | |
| 2,672,095 | 3/1954 | Lucien et al. | 417/269 |
| 2,675,759 | 4/1954 | Yarger . | |
| 2,819,678 | 1/1958 | Nordell et al. . | |
| 2,821,932 | 2/1958 | Lucien | 417/269 |
| 2,918,879 | 12/1959 | Cervo | 417/269 |
| 3,183,847 | 5/1965 | Raymond | 417/269 |
| 3,357,363 | 12/1967 | Raymond . | |
| 3,413,929 | 12/1968 | Cook et al. . | |
| 3,514,223 | 3/1970 | Hare | 91/499 X |
| 3,691,910 | 9/1972 | Reichel et al. . | |
| 4,464,979 | 8/1984 | Forster . | |
| 4,579,043 | 1/1986 | Nikolaus et al. . | |
| 4,602,554 | 7/1986 | Wagenseil et al. . | |
| 4,615,257 | 10/1986 | Valentin | 91/499 |
| 4,642,032 | 2/1987 | McBeth . | |
| 4,860,641 | 8/1989 | Spears . | |
| 5,086,689 | 2/1992 | Masuda . | |
| 5,236,312 | 8/1993 | Finn et al. . | |
| 5,320,498 | 6/1994 | Fuchida . | |

FOREIGN PATENT DOCUMENTS

| | | | |
|---|---|---|---|
| 120474 | 12/1965 | Netherlands | 91/499 |
| 1631196 | 2/1991 | U.S.S.R. | 91/499 |

*Primary Examiner*—John E. Ryznic
*Attorney, Agent, or Firm*—Jansson & Shupe, Ltd.

[57] ABSTRACT

The disclosure relates to a pump having a wobble plate, at least one piston assembly reciprocated by the wobble plate, and a mechanism retaining the piston assembly in contact with the wobble plate. In the improvement, the mechanism includes a hold-down plate having a number of radially-extending retention fingers. Each finger extends into a fill opening of a separate piston assembly and retains such assembly in contact with the pump wobble plate. The piston shoe is maintained in sliding contact with the wobble plate; that is, separation of the piston assembly from the wobble plate is thereby substantially prevented.

12 Claims, 9 Drawing Sheets

PISTON PUMP WITH IMPROVED HOLD-DOWN MECHANISM

FIELD OF THE INVENTION

This invention relates generally to pumps and, more particularly, to pumps having plural pumping pistons reciprocated by a wobble plate.

BACKGROUND OF THE INVENTION

The preponderance of hydraulic pumps made today fall into one of three broad design types, namely, gear, vane and piston. Piston pumps are further broken down into two design types, namely, valve plate and check ball pumps. As examples, the pumps depicted in U.S. Pat. Nos. 4,579,043 (Nikolaus et al.) and 4,602,554 (Wagenseil et al.) are of the valve plate type while that depicted in U.S. Pat. No. 3,514, 223 (Hare) is a check ball pump. Some features of valve plate and check ball pumps will now be described.

Valve plate pumps include a cylinder barrel having a number of pistons reciprocating in it. Such barrel is coupled to the pump shaft and rotates with the shaft and as a consequence, the pistons in a valve plate pump both rotate with the pump barrel and reciprocate in such barrel.

Such pistons are caused to reciprocate by rotating the barrel with respect to a stationary "swash plate" or wobble plate. Barrel rotation urges pistons toward a fluid-porting cover as the piston shoe moves along the "rising" part of the wobble plate. Fluid, e.g., hydraulic oil, between the distal end of the piston and the cover is expelled through the cover and into a tube or hose to perform useful work. As the pistons move along the "falling" part of the wobble plate, they move away from the cover and draw fluid into the enlarging cavity between the cover and the piston distal end.

At their proximal ends, the pistons typically have a flat-faced shoe that rides along the angled face of the wobble plate. During pump operation, it is important to maintain the shoe in contact with such face - - - shoe "liftoff" can result in a damaged shoe and, in a more aggravated case, in a pump that destroys itself.

In a valve plate piston pump, there are a number of ways to hold the piston shoes in contact with the wobble plate. One way is to use an annular plate having a number of holes formed therein equal to the number of pistons. Such plate, shown in the Wagenseil et al. patent, for example, and identified therein as a "contact pressure plate," closely resembles the dial plate of a rotary-dial-type telephone. Other ways to hold a piston in contact with an undulating surface in a valve plate pump is by an internal spring (U.S. Pat. No. 5,320,498 (Fuchida) or by a "head-grasping" arrangement as shown in U.S. Pat. No. 4,860,641 (Spears).

In a typical check ball pump like that shown in the Hare patent, the barrel having the reciprocating pistons does not rotate. On the other hand, the wobble plate (or a thrust plate analogous to the wobble plate) rotates when driven by the pump shaft. The interior of the pump housing is flooded with oil and as each piston moves away from the front cover, the cavity between the piston distal end and the pump cover fills with oil. Filling is through one or more piston "fill holes" in fluid communication with the flooded housing interior and the piston cavity and oil which flows through such holes then flows across an inlet check valve inside the piston. This part of piston travel is often referred to as the "suction stroke."

As the wobble plate continues rotation and a piston moves toward the front cover, its discharge check valve (mounted in the pump cover) opens and the volume of oil in the aforedescribed cavity is expelled through the cover and into a tube or hose to perform useful work. This part of piston travel is often referred to as the "discharge stroke" or "pressure stroke."

While check valve pumps have been available for decades and have proven sturdy and reliable even in harsh operating environments, it has become apparent that steps needed to be taken to obtain greater displacement from a given frame size. However, certain structural features, seemingly inherent in pumps of this type, militate against significant increases in such displacement.

Such features relate to the need to hold the shoe of each reciprocating piston in intimate contact with the rotating wobble plate. A common technique, depicted in the Hare patent noted above, involves a spring retainer plate attached at a reduced-diameter "neck" between the spherical piston head and the cylindrical body. A trepan groove is formed in the pump barrel concentric with each piston bore and a compression-type piston return spring is mounted in the groove. When the piston is inserted in the barrel, the spring bears against the retainer plate and urges the piston toward the wobble plate.

A fact of this arrangement is that for a given housing cavity size (and pump size and "mass"), the spring and retainer plate occupy a significant part of the cavity volume. Another fact is that as the springs and retainer plates move through the oil contained in the cavity, there is necessarily some loss in efficiency. Simply put, the oil resists movement of the plate and spring.

Yet another aspect of the above-noted check valve pump design is that the piston fill holes are required to be relatively small. As a consequence, inlet supercharge is indicated for many installations since the pistons would not other-wise fill properly. Users often resist having to provide such supercharge and the maximum speed of the pump is somewhat limited. Yet another fact is that if supercharge is increased beyond a few pounds per square inch, one has to consider the use of high pressure shaft seals.

The known arrangement (as typified by the pump of the Hare patent) involves a relatively large number of parts. Further, many of such parts were required to be machined in a way that, in view of the invention, is unnecessary. For example, the pistons of the pump shown in the Hare patent have "necked-down" portions machined therein adjacent to the piston shoe. A snap ring groove is machined in such necked-down portion to receive a snap ring for holding the shoe on the end of the piston. And because of the relatively large number of parts, the time required to assemble a pump of the type shown in such patent is rather significant.

An improved piston pump which overcomes some of the problems and shortcomings of known pumps would be an important advance in the art.

OBJECTS OF THE INVENTION

It is an object of the invention to provide a pump having an improved piston hold-down mechanism overcoming some of the problems and shortcomings of the prior art.

Another object of the invention is to provide a pump having an improved piston hold-down mechanism involving a simplified piston construction.

Another object of the invention is to provide a pump having an improved piston hold-down mechanism including a simplified piston shoe.

Yet another object of the invention is to provide a pump having an improved piston hold-down mechanism which is highly effective in retaining piston shoes in contact with a wobble plate.

Another object of the invention is to provide a pump having an improved piston hold-down mechanism permitting substantially increased pump displacement for a given pump "frame" size.

Still another object of the invention is to provide a pump having an improved piston hold-down mechanism permitting higher pump operating speeds.

Another object of the invention is to provide a pump having an improved piston hold-down mechanism facilitating improved piston filling characteristics.

Yet another object of the invention is to provide a pump which reduces or eliminates the need for inlet supercharge, at least up to higher operating speeds than heretofore possible.

Another object of the invention is to provide a pump having an improved piston hold-down mechanism and wherein the pump is incrementally more efficient.

Yet another object of the invention is to provide a pump having an improved piston hold-down mechanism facilitating more expeditious pump assembly. How these and other objects are accomplished will become apparent from the following descriptions and from the drawing.

SUMMARY OF THE INVENTION

The invention involves a piston pump of the type having a wobble plate and at least one piston assembly reciprocated by the wobble plate. Each such assembly includes a piston and a piston shoe, the piston having at least one fill opening through the piston wall and into the piston interior. The improved mechanism retaining the piston assembly in contact with the wobble plate includes a hold-down plate having one or more radially-projecting retention fingers. Each retention finger extends into the fill opening of a different piston assembly and contacts such assembly for retaining it in contact with the wobble plate. Separation of the piston assembly from the wobble plate is thereby substantially prevented.

In another aspect of the invention, the pump has an axis of rotation about which the wobble plate and wobble-plate-driving shaft rotate. The wobble plate has a center of rotation and a surface which is angular with respect to such axis of rotation. In one highly preferred embodiment, the hold-down plate is supported on a "ball-and-socket" type pivot device permitting undulating movement of such hold-down plate as the shaft and wobble plate rotate. The hold-down plate is thereby maintained in a positional relationship with respect to the angled wobble plate surface.

A highly preferred embodiment of the pivot device includes a spherical guide member coupled to the hold-down plate and a tube-like sleeve member having a spherical pocket in which the guide member is received. Such pivot device permits undulating movement of the guide member with respect to the sleeve member.

And piston hold-down force may be provided in either of at two ways using the above-described pivot device. In one arrangement, the sleeve member is capable of limited axial movement with respect to the wobble plate center of rotation, i.e., movement toward and away from such center. In one preferred arrangement, referred to as a "positive hold-down" arrangement, a mechanical stop is used to restrain the sleeve member at a position with respect to the center of rotation.

Such "fixed clearance" position is selected so that the piston shoes are retained in contact with the wobble plate surface with some minimal force while yet avoiding unduly high force against such shoes and surface. Excessive hold-down force may cause "hot spots" and unnecessarily accelerate shoe and/or wobble plate wear. At least because of manufacturing machining tolerances, it is preferred that the mechanical stop be adjustable, thereby permitting final adjustment of the position of the sleeve member at the time of pump final assembly.

In another preferred arrangement for providing piston hold-down force, the pump includes a compression spring interposed between the sleeve member and the pump barrel. Such spring urges the sleeve member toward the wobble plate and, thus, urges the piston shoes into contact with such wobble plate. In this arrangement, piston hold-down is independent of manufacturing tolerances since the spring "takes up" and eliminates any clearance between the piston shoes and the wobble plate surface.

In another preferred embodiment, the pivot device is a bearing having a spheroid member and an annular, ring-like outer race mounted on the spheroid member for undulating movement. The hold-down plate is supported by the outer race and a compression spring backed by a spring washer urges the bearing toward the wobble plate and retains the piston shoes in contact with the wobble plate surface.

And that is not all. The new hold-down mechanism includes a piston assembly having a piston and piston shoe which are greatly simplified as compared to corresponding pistons and piston shoes of prior art check ball pumps. Specifically, the new piston assembly includes a piston which is generally cylindrical and which has a spheroid head at its proximal end. The piston shoe has a spheroid cavity receiving the head and the shoe is retained between the head and the wobble plate solely by being "captured" therebetween. To put it another way, the preferred piston assembly is free of machined "necked-in" portions and of attachment devices such as the snap ring engaging the piston shoe rim, both as shown in the Hare patent.

In yet another aspect of the invention, the piston includes a finger-contact portion, i.e., a portion contacted by a retention finger for retaining the piston assembly (and, specifically, the piston shoe) in contact with the wobble plate surface. In one preferred arrangement, the finger-contact portion comprises a ball in the piston interior cavity at the piston proximal end. In another preferred arrangement, the finger-contact portion comprises a raised portion integral to the piston and projecting toward the piston distal end. And in yet another preferred arrangement, the finger-contact portion comprises the edge of a fill opening.

DETAILED DESCRIPTION OF PREFERRED EMBODIMENTS

Figure 1:
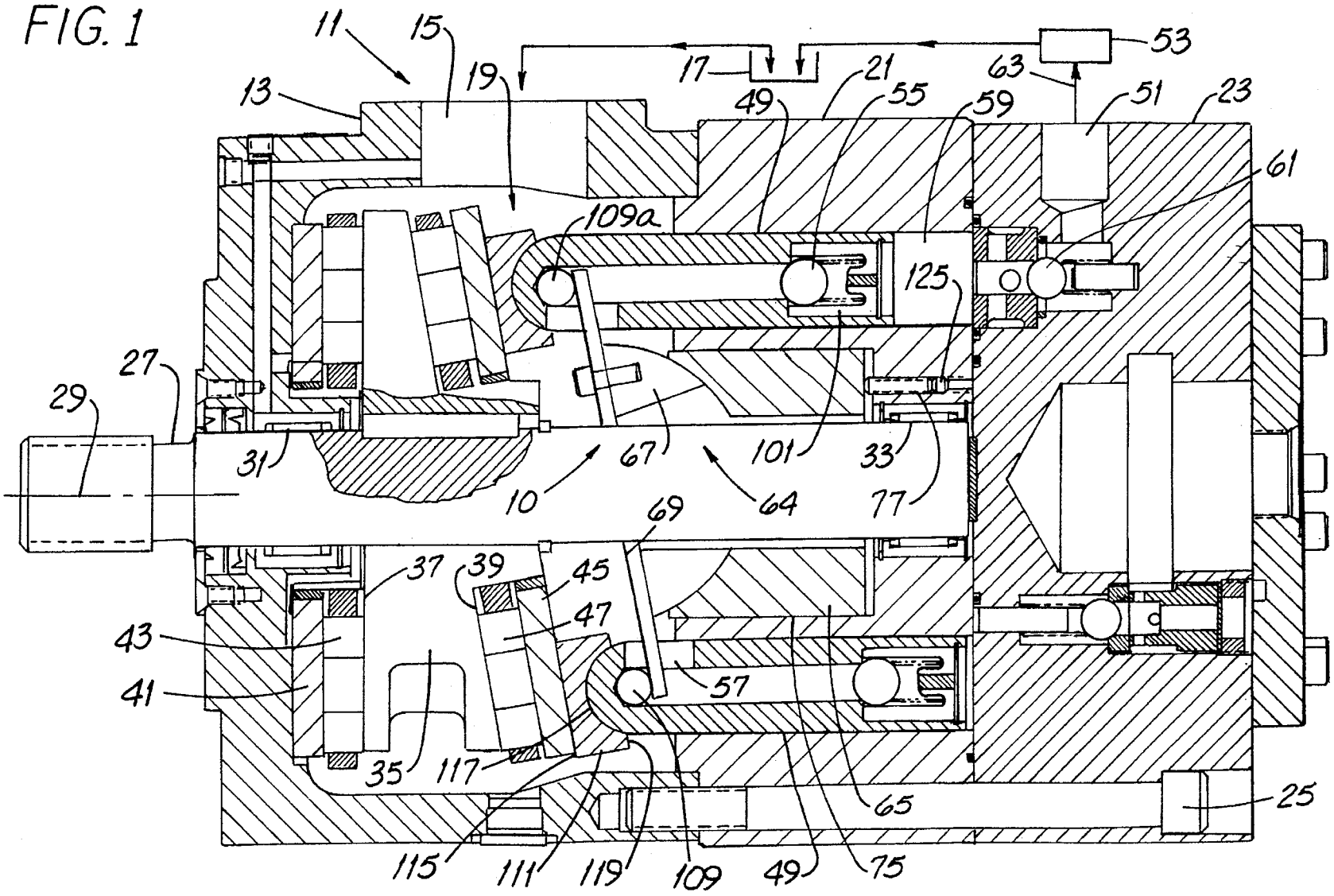
FIG. 1 is a cross-sectional side elevation view of a check valve piston pump incorporating the inventive hold-down mechanism. Parts are broken away and cross-hatching is omitted on certain other parts.

Before describing the many new features of the inventive hold-down mechanism 10, a general description of the construction and operation of one type of check ball pump 11 will be provided. The pump 11 is assumed to be used with some type of liquid pressure medium, e.g., ethylene glycol, hydraulic oil or the like. (In this specification, terms such as "left," "right" and the like are with respect to the drawing, are used for ease of explanation and are not limiting.)

Referring to FIG. 1, the pump 11 has a housing 13 with an inlet opening 15 leading from a reservoir 17 of fluid to an interior cavity 19. A barrel 21 and cover 23 are attached to the housing 13 by bolts 25. The pump drive shaft 27 extends through the housing 13 and is supported for rotation about the axis 29 by spaced sets 31 and 33 of needle bearings mounted in the housing 13 and in the barrel 21, respectively. The shaft 27 is coupled to and driven by a prime mover such as an internal combustion engine or an electric motor, not shown.

The shaft 27 is keyed or otherwise attached to a circular, wedge-shaped wobble plate 35 having a planar left face 37 generally normal to the axis 29 and a planar right face 39 angled with respect to such axis 29. The pump 11 also has an annular, flat left thrust plate 41 and a "pancake-type" thrust bearing 43 interposed between the face 37 and the thrust plate 41. Similarly, there is a right thrust plate 45 and a thrust bearing 47 interposed between such thrust plate 45 and the right face 39 of the wobble plate 35.

Neither the thrust plates 41, 45 nor the thrust bearings 43, 47 are attached to the shaft 27 or to the wobble plate 35 in a way to cause such plates 41, 45 or bearings 43, 47 to rotate at shaft speed. However, "viscous drag," more prevalent with hydraulic oil than with thinner liquid such as ethylene glycol, tends to cause such plates 41, 45 and bearings 43, 47 to rotate about the axis 29 at a relatively modest rate. The aforedescribed arrangement of housing 13, barrel 21, shaft 27, wobble plate 35, thrust plates 41, 45 and thrust bearings 43, 47 is known.

The manner in which a particular piston assembly 49 delivers fluid to a pressurized outlet port 51 and thence to a hydraulic "work-performing" circuit 53 will now be described. As the wobble plate 35 rotates, each assembly, e.g., assembly 49, moves leftward and its inlet check valve 55 unseats. Liquid is thereby permitted to flow from the housing cavity 19 through one or more piston fill holes 57 and into the piston interior. Such liquid fills the cavity 59 between the piston distal or right end and an outlet check valve 61 in the cover 23 and it is to be appreciated that during such leftward movement of the assembly 49, the volume of such cavity 59 is increasing.

As the piston assembly 49 starts to move rightward, the inlet check valve 55 closes, the pressure in the cavity 59 rises rapidly and the outlet check valve 61 opens when such pressure slightly exceeds the pressure in the outlet circuit 63. The volume of the cavity 59 diminishes and fluid in the cavity 59 is thereby delivered to such circuit 63. From the foregoing, it will be appreciated that each piston assembly 49 makes one leftward "suction" excursion and one rightward "pressure" excursion for each revolution of the wobble plate 35.

Often, the fluid expelled from the several piston cavities 59 is directed to a common circuit 63 connected to the outlet port 51. However, "Split-Flow"® configurations are possible wherein groups of piston assemblies 49, each comprising less than all of the assemblies 49 in the pump 11, power separate outlet ports 51.

Details of an embodiment of the new hold-down mechanism 10 will now be described. That will be followed by an explanation of how such mechanism 10 operates. Referring also to FIGS. 2, 3, 4, 5 and 6 the new mechanism 10 has a pivot device 64 including a hold-down sleeve 65, a spherical guide member 67 and a hold-down plate 69. Each is described in turn.

The hold-down sleeve 65 is tubular, generally cylindrical and has a spherical pocket 71 formed in one end. The pump shaft 27 extends through the central opening 73 and the sleeve 65 is retained in a cylindrical cavity 75 formed in the barrel 21. The barrel 21 also includes an adjustable mechanical stop 77, the function of which is described below.

The spherical guide member 67 has a central opening 79 for receiving the shaft 27 therethrough. The "bearing" surface 81 of the guide member 67 is spherical and conforms to the shape of the pocket 71 in the sleeve 65 so that the guide member 67 and sleeve 65 form what may be termed a "ball-and-socket" joint. That surface 83 opposite the bearing surface 81 is generally flat and has holes 85 for receiving fasteners attaching the hold-down plate 69 to the member 67.

Figure 5:
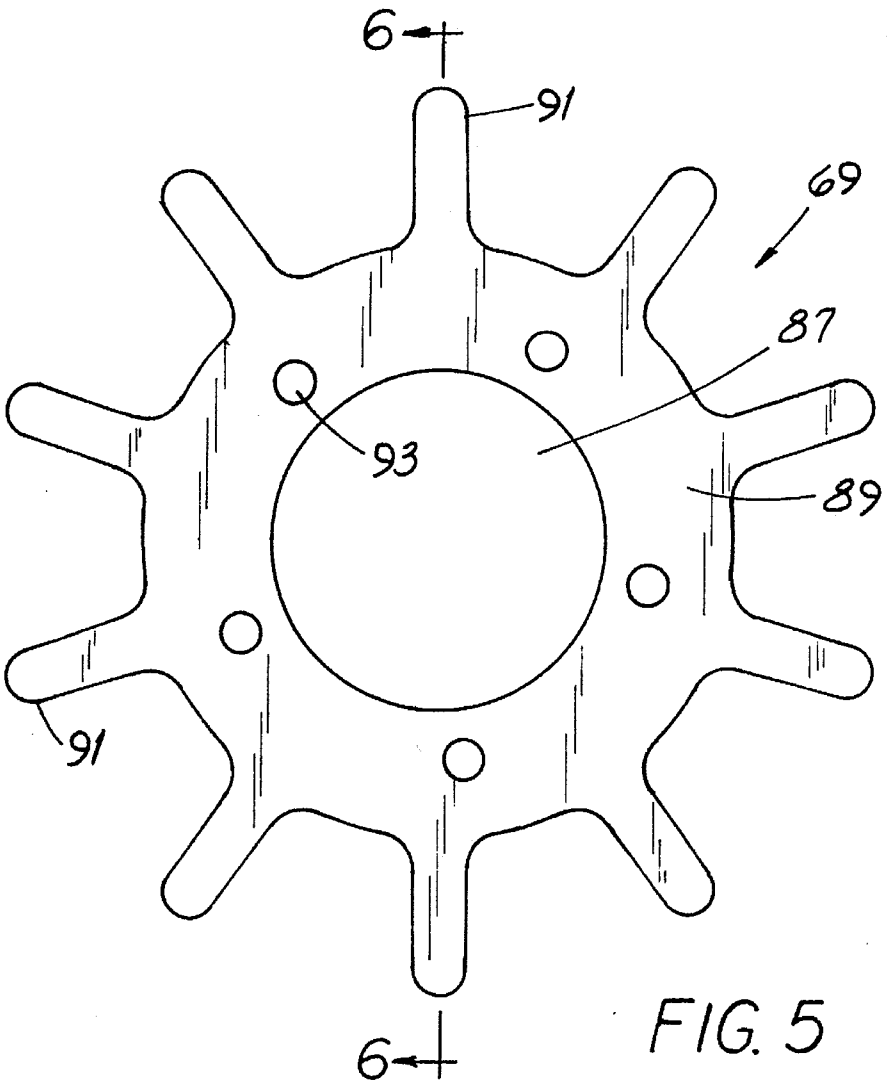
FIG. 5 is an end view of the hold-down plate used in the pump of FIG. 1.
Figure 6:
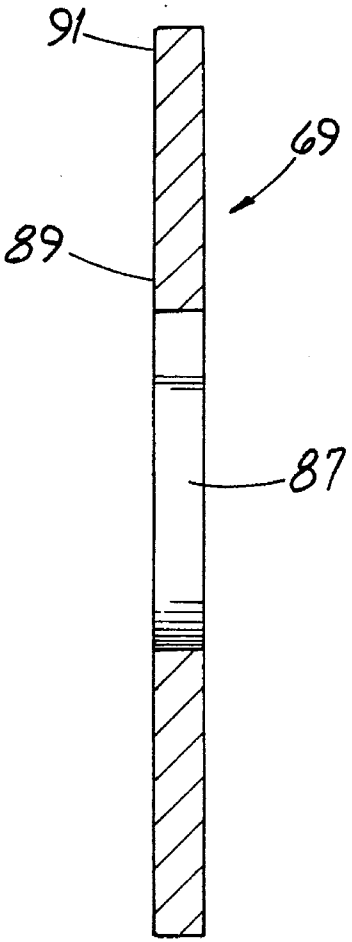
FIG. 6 is a cross-sectional view of the hold-down plate of FIG. 5 taken along the viewing plane 6—6 thereof.

Referring particularly to FIGS. 1, 5 and 6, the disc-like hold-down plate 69 is generally flat, has a central aperture 87, an annular body 89 and a plurality of retention or hold-down fingers 91 projecting radially outward from such body 89. In a highly preferred arrangement, the number of fingers 91 and the number of piston assemblies 49 in the pump 11 are equal to one another. The plate 69 also includes a number of holes 93 used to attach the plate 69 to the guide member 67 as described above.

Figure 7:
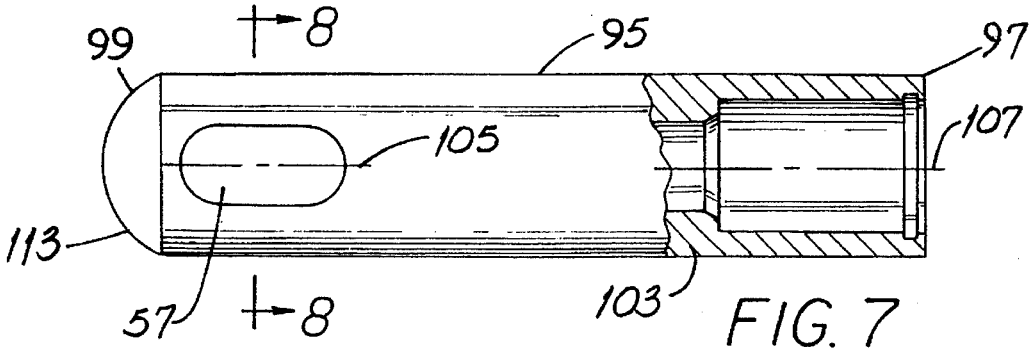
FIG. 7 is a side view of a piston used in the pump of FIG. 1. Parts are broken away and shown in cross-section.
Figure 8:
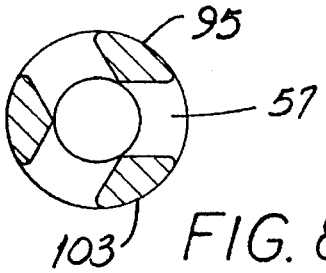
FIG. 8 is a cross-section view of the piston of FIG. 7 taken along the viewing plane 8—8 thereof.

Referring particularly to FIGS. 1, 7 and 8, a piston assembly 49 will now be described. Such assembly 49 includes a hollow, generally cylindrical piston 95 having a "squared-off" distal end 97 and a spherical proximal end 99. An inlet check valve 55 and ball-retaining cage 101 are secured in the end 97. There are one or more piston fill holes 57 through the piston wall 103 and such holes 57 permit liquid from the housing cavity 19 to flow into and through the piston 95 as each piston assembly 49 is reciprocated as described above.

In a highly preferred embodiment, there are three elongate holes 57 in the wall 103 and such holes 57 are spaced about 120° apart around the piston circumference. The long axes 105 of such holes are generally parallel to the long axis 107 of the piston 95 and to the pump axis of rotation 29. While a specific fill hole configuration has been described, it should be appreciated that the number and configuration of such fill holes 57 may vary without departing from the spirit of the invention.

Figure 9:
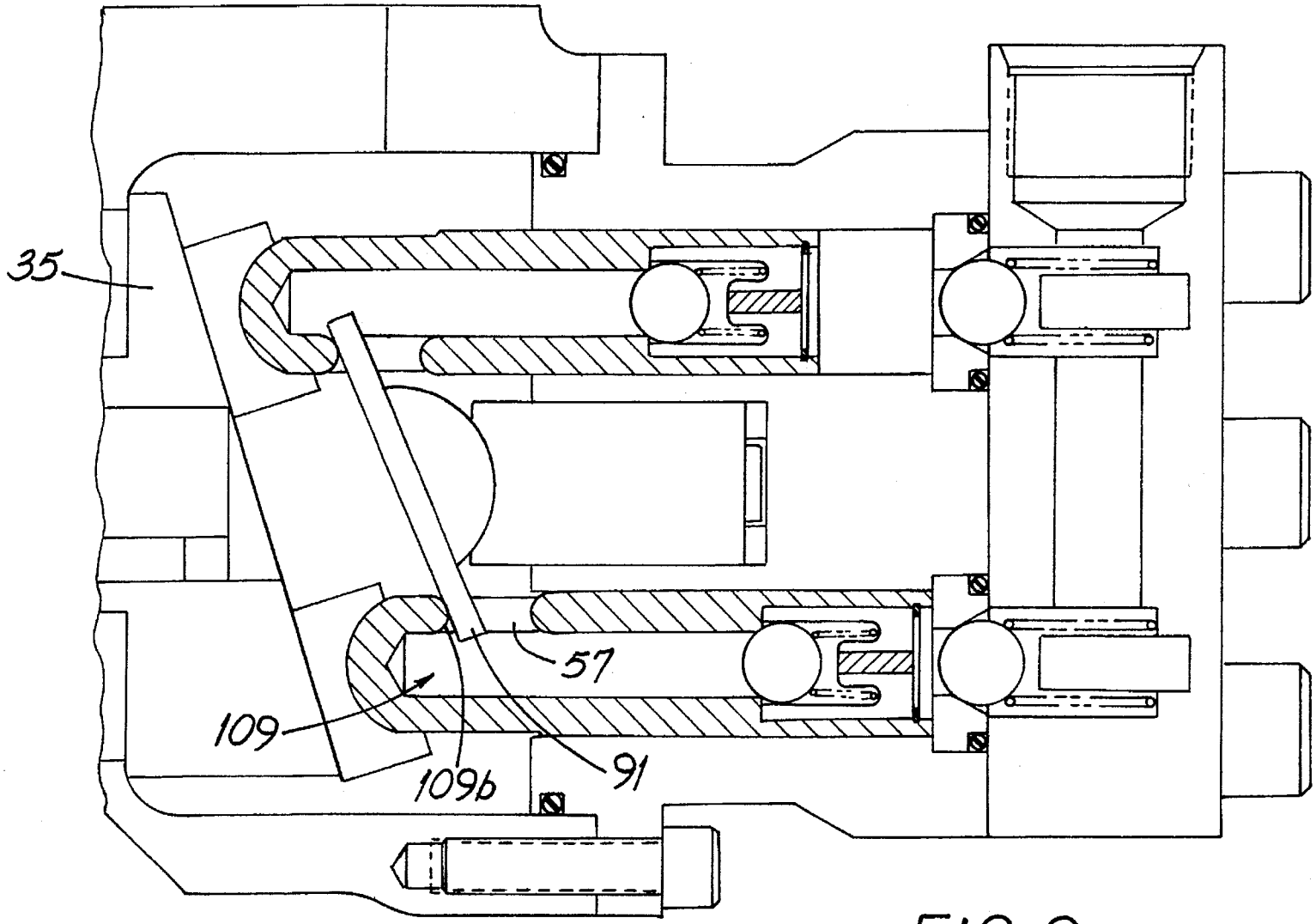
FIG. 9 is a side elevation view of another embodiment of the inventive hold-down mechanism shown in conjunction with another type of check valve pump.

Each piston assembly 49 also includes a finger-contact portion 109 against which a hold-down finger 91 bears to retain the piston shoe 111 in contact with the plate 45. In the embodiment shown in FIG. 1, the portion 109 comprises a ball 109*a* in the piston interior at the piston proximal end 113. (During assembly, such ball 109*a* is held in place by a small quantity of grease and thereafter is "captured" between a finger 91 and the proximal end 113.) In another embodiment shown in FIG. 9, the finger-contact portion 109 comprises a rounded edge 109*b* of the piston wall 103 (and, specifically, a rounded end of a fill hole 57) against which the hold-down finger 91 bears.

Referring again to FIG. 1, the piston assembly 49 includes a shoe 111 interposed between the plate 45 and the proximal end 113 of the piston 95. Such shoe 111 is generally cylindrical, has a flat bearing surface 115 and a spherical surface 117 the latter conforming to the shape of the spherical proximal end 113.

Figure 10:
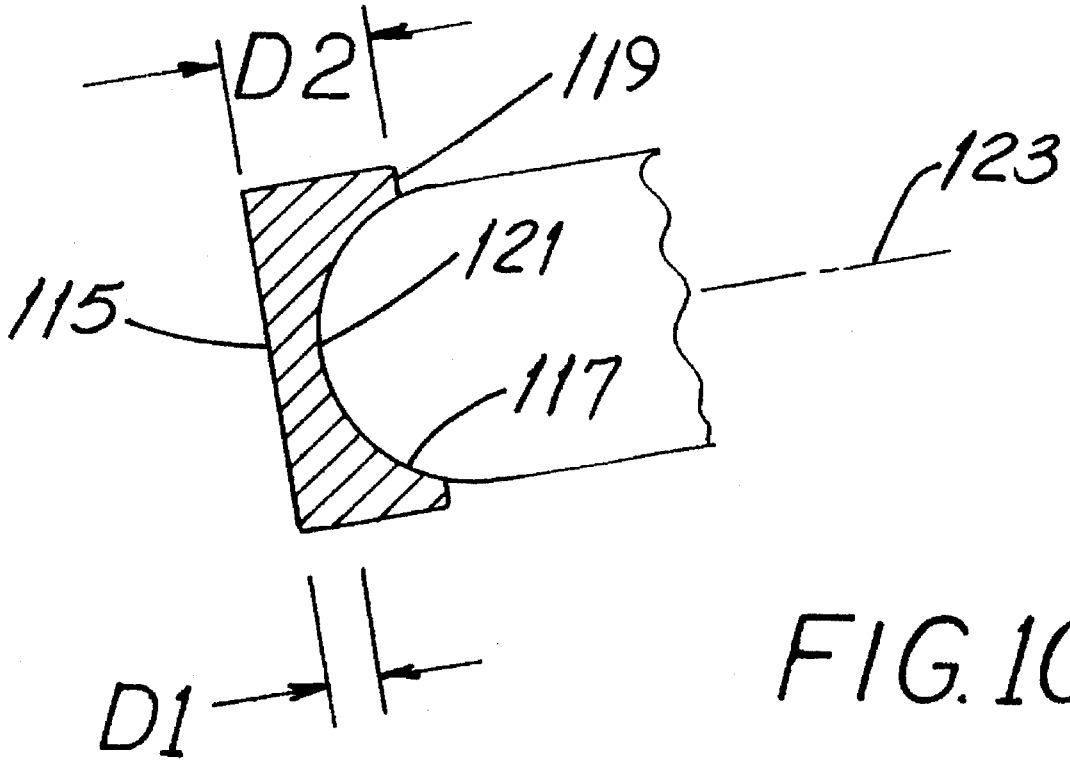
FIG. 10 is a side elevation view of a piston shoe in cross-section and the piston associated with such shoe. Parts are broken away.

Referring also to FIG. 10, an annular shoulder 119 circumscribes the spherical surface 117 and it is to be noted that the dimension "D1" from the center 121 of the surface 117 to the surface 115 is less than the dimension "D2" from the shoulder 119 to such surface 115. When the piston 95 and shoe 111 are cooperatively configured in that way, the shoe 111 is retained between the piston 95 and the plate 45 solely by being "captured" therebetween. To put it another way, there is no need for complex shoe and piston configurations involving use of a shoe-attaching snap ring as shown in the above-noted Hare patent.

The pump parts are assembled as shown in FIG. 1. A separate hold-down finger 91 extends into a fill hole 57 of each piston 95 and bears against the piston finger-contact portion 109, whether ball 109*a*, or piston wall 109*b*. The threaded mechanical stop 77 is adjusted so that the guide member 67 undulates freely in the pocket 71 of the sleeve 65 and so that the piston shoes 111 can undulate freely about an axis 123 perpendicular to the shoe surface 115. In other words, adjustment should be such that there is no "binding" of such parts. The lock screw 125 is then tightened against the stop 77 and the shoes 111 are retained in a "fixed clearance" relationship with respect to the plate 45. In this "positive hold-down" arrangement, the shoes 111 are not urged against the plate 45; rather, they are prevented from moving away from such plate 45.

In operation, the pump shaft 27 and wobble plate 35 are rotated and the piston assemblies 49 are thereby caused to reciprocate, each pumping liquid into the circuit 63. During such operation, the hold-down plate 69 and guide member 67 exhibit what may be described as undulating movement. Since the hold-down plate 69 is always spaced from and parallel to the wobble plate face 39, the piston assemblies 49 (and, specifically, the piston shoes 111) are continuously "held down" against the plate 45.

Figure 12:
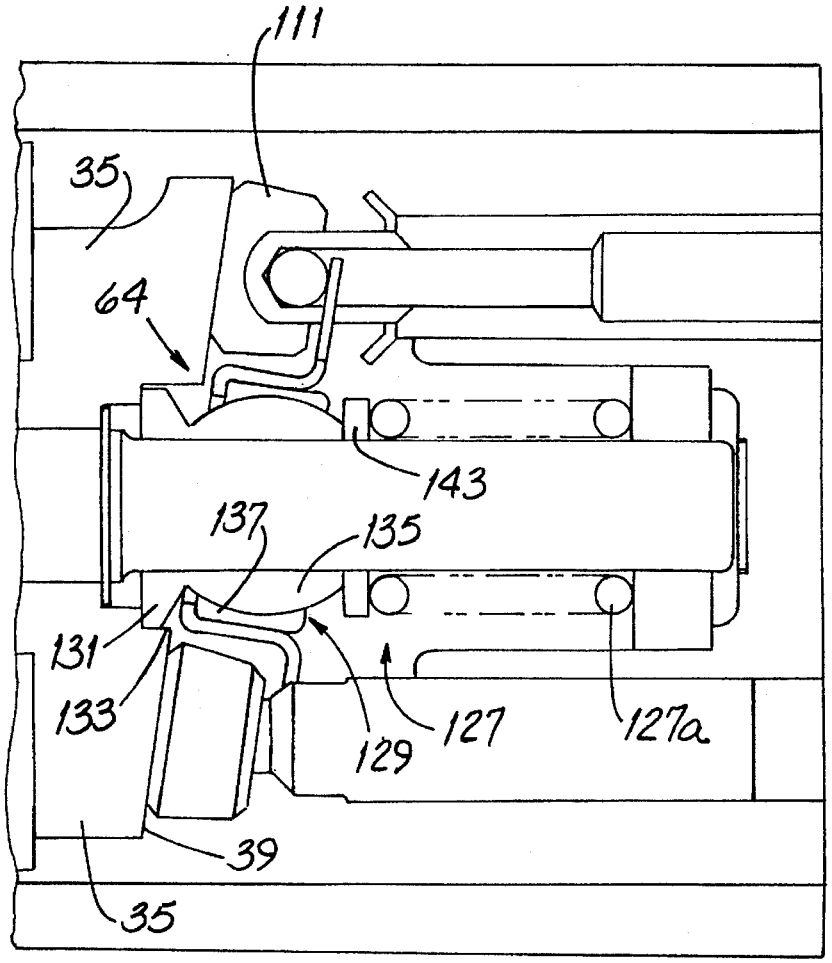
FIG. 12 is a cross-sectional side elevation view of still another type of check valve piston pump incorporating yet another embodiment of the new hold-down mechanism. Parts are broken away.
Figure 11:
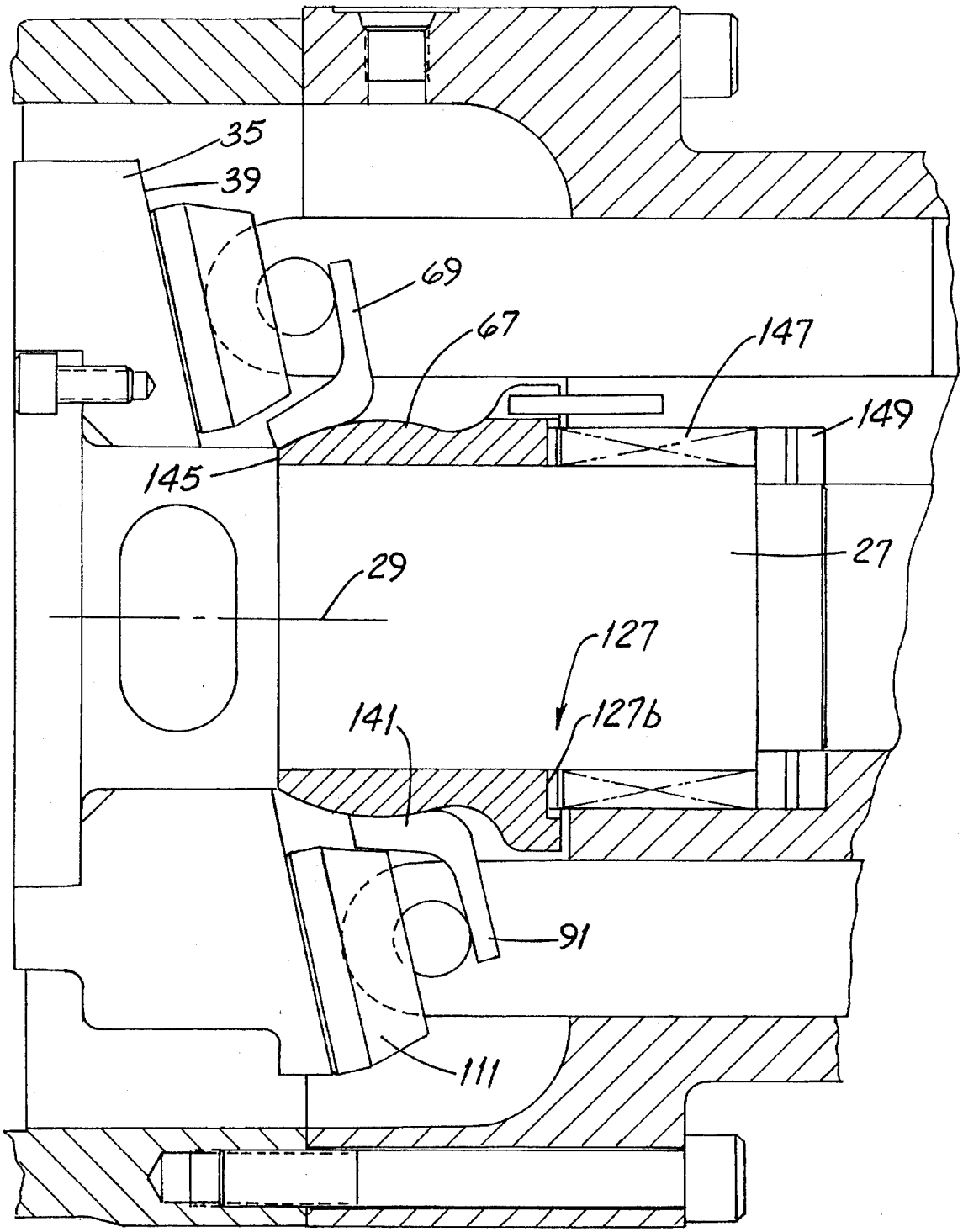
FIG. 11 is a cross-sectional side elevation view of yet another type of check valve piston pump incorporating another embodiment of the new hold-down mechanism. Parts are broken away and cross-hatching is omitted on certain other parts.
Figure 15:
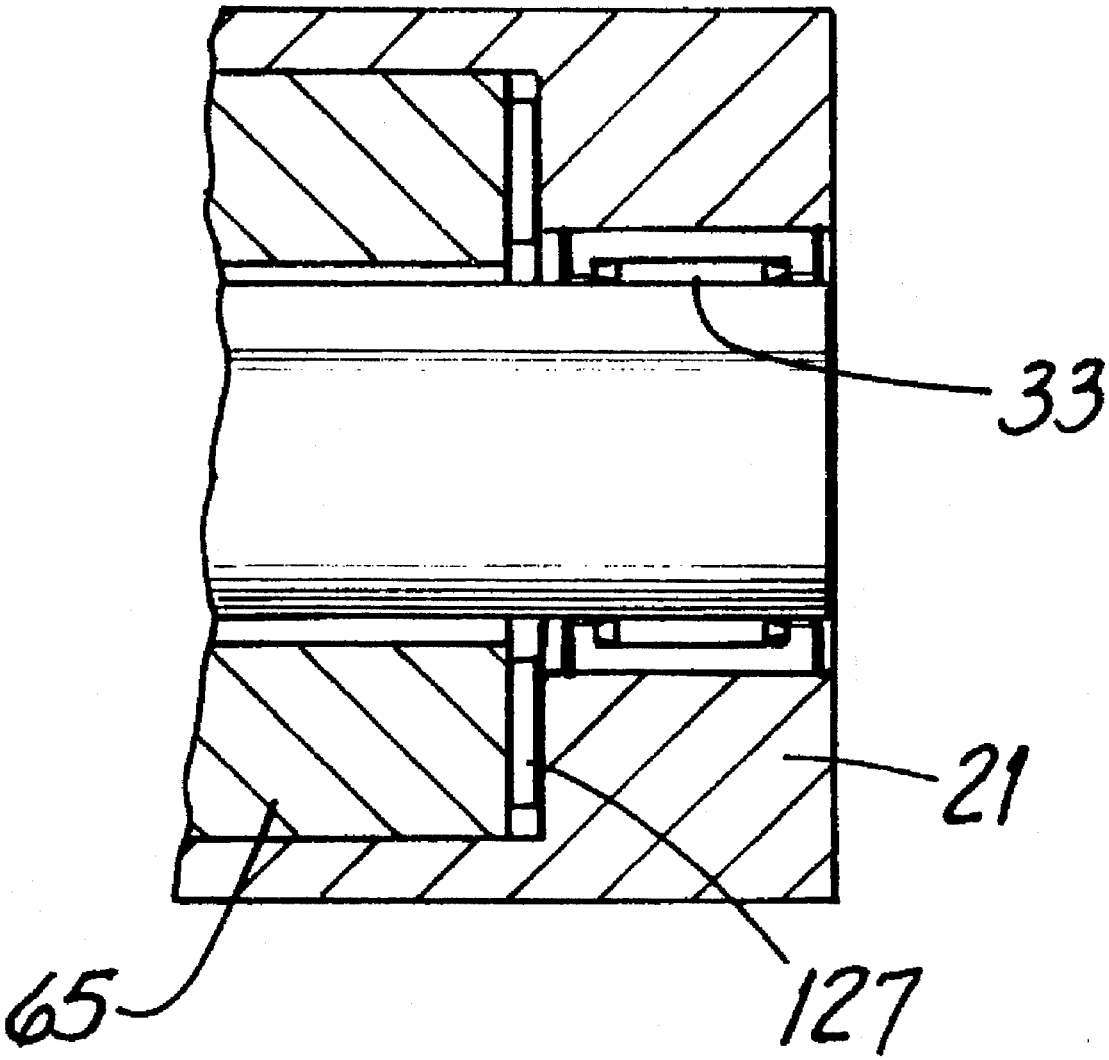
FIG. 15 is a cross-sectional side elevation view of a portion of the pump of FIG. 1 and shows a compression member in place of the mechanical stop shown in FIG. 1.

Referring now to FIGS. 11, 12 and 15, a compression member 127 may be used in place of the mechanical stop 77. Such compression member 127 may comprise a coil spring 127*a* or a high-rate spring like a wave spring 127*b*. (Wave springs are annular and have radially-oriented crests and valleys. A source of wave springs is Smalley Steel Ring Co. of Wheeling, Ill.) In this configuration, the piston shoes 111 are urged against the wobble plate surface 39 by the compression member 127 but may move away from such surface 39 at least slightly if the force of the compression member 127 is overcome.

Figure 14:
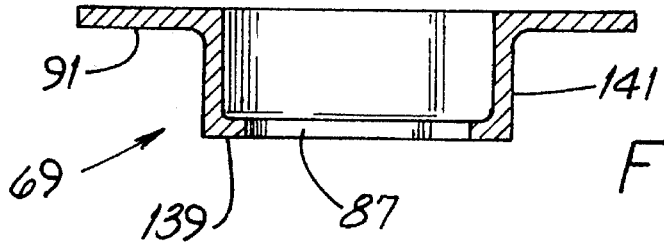
FIG. 14 is a cross-sectional view of the hold-down plate of FIG. 13 taken along the viewing plane 14—14 thereof.
Figure 13:
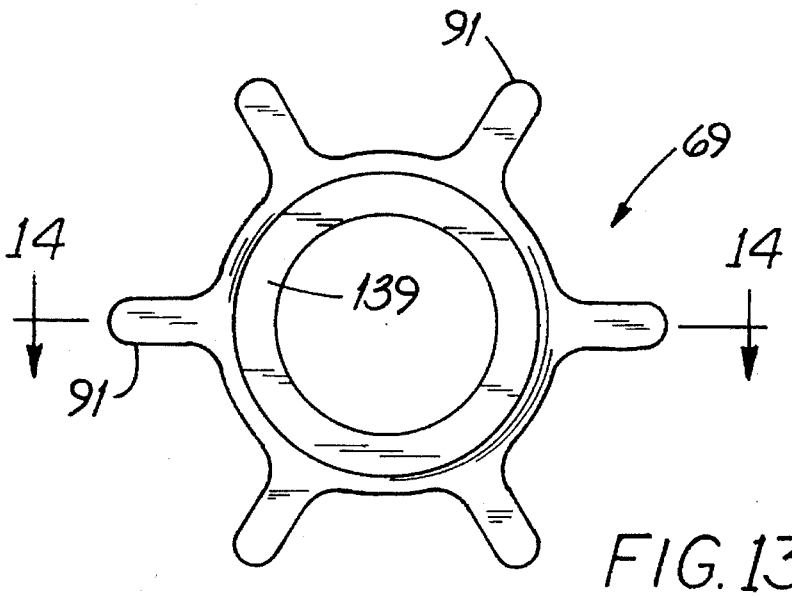
FIG. 13 is an end view of the hold-down plate used with the pump of FIG. 12.
Figure 2:
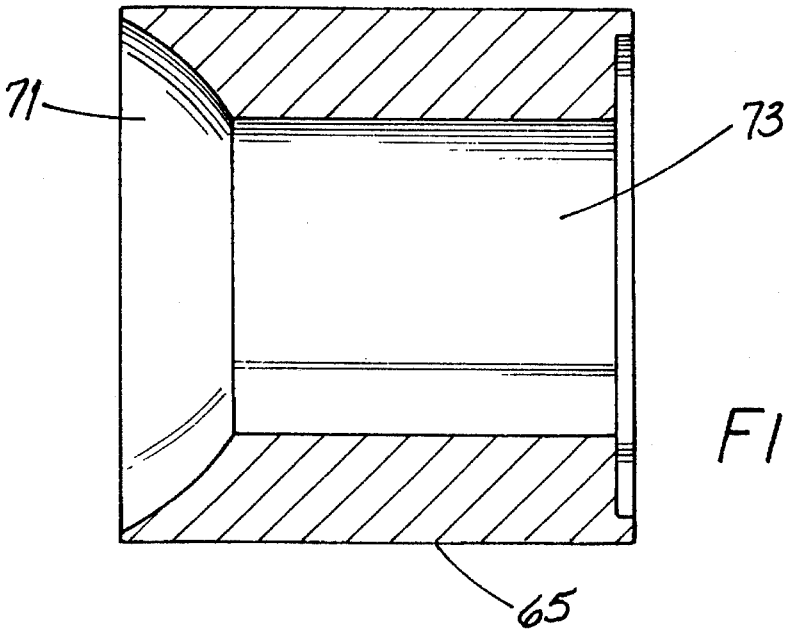
FIG. 2 is a cross-sectional side elevation view of the hold-down sleeve used in the pump of FIG. 1.
Figure 4:
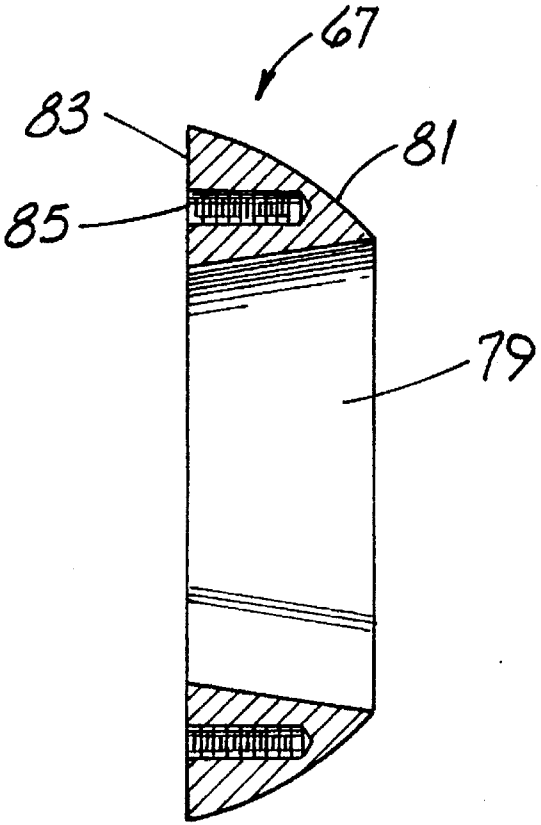
FIG. 4 is a cross-sectional view of the guide member of FIG. 3 taken along the viewing plane 4—4 thereof.
Figure 3:
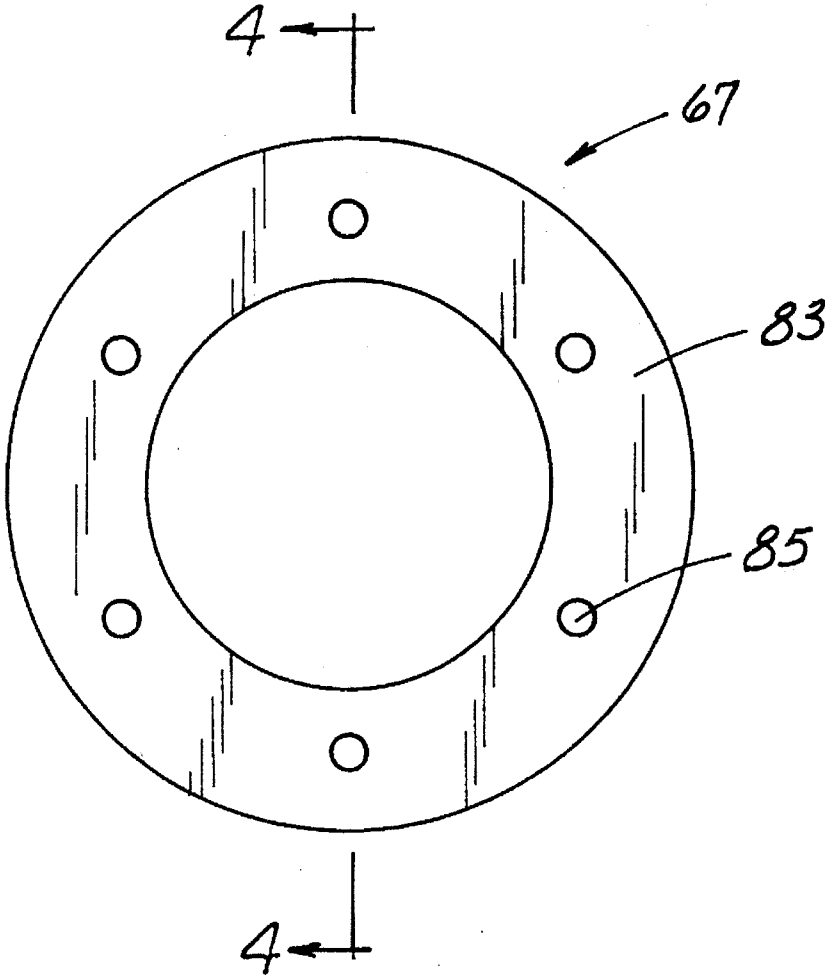
FIG. 3 is an end view of the guide member used in the pump of FIG. 1.

Referring next to FIGS. 12, 13, and 14, another embodiment of the new hold-down mechanism 10 will now be described. In the arrangement of FIGS. 12, 13 and 14 (which involves a six-piston pump 11), the pivot device 64 is a bearing 129 having a base 131 received in a socket 133, a spheroid member 135 and an annular, ring-like outer race 137 mounted on the spheroid member 135 for undulating movement.

In cross-section, the hold-down plate 69 is "hat-shaped" and has an annular retaining lip 139, a cylinder-like annular side wall 141 and retention fingers 91 perpendicular to and extending radially outward from the side wall 141. The lip 139 and side wall 141 engage and are supported by the outer race 137. A compression spring 127*a* backed by a spring washer 143 urges the bearing 129 toward the wobble plate 35 and retains the piston shoes 111 in contact with the wobble plate 35.

The embodiment of FIG. 11 differs only slightly from those described above and includes a guide member 67 urged against a load-bearing shaft abutment shoulder 145 by a wave spring 127*b*. A hold-down plate 69 rides on the guide member 67 and exhibits undulating motion with respect thereto when the pump 11 is operating. In cross-section, the hold-down plate 69 is generally hat-shaped (like that of FIGS. 13 and 14) but rather than being normal to the fingers 91, the side wall 141 is somewhat angular thereto in a direction toward the shaft axis of rotation 29. The right end of the shaft 27 is positioned by a needle bearing 147 and by a disc-like thrust bearing 149.

As set forth above, this specification includes a description of the pumps 11 of FIGS. 11 and 12 in which the piston shoes 111 ride on the surface of a wobble plate 35 rotating at shaft speed. As used in this specification, the terms "wobble plate," "wobble plate surface" and the like refer to or relate to that component of the pump 11 upon which the piston shoes 111 ride, irrespective of whether such component is a wobble plate 35 rotating at shaft speed or is a thrust plate 45.

While the principles of the invention are description in connection with preferred embodiments, it is to be understood clearly that such embodiments are by way of example and are not limiting.

What is claimed:

1. In a pump having (a) a wobble plate, (b) at least one piston assembly reciprocated by the wobble plate, such assembly including a piston having a fill opening, and (c) a mechanism retaining the piston assembly in contact with the wobble plate, the improvement wherein the mechanism comprises:

a retention finger extending into the fill opening and contacting the piston assembly for retaining such assembly in contact with the wobble plate, whereby separation of the piston assembly from the wobble plate is substantially prevented.

2. The pump of claim 1 including a hold-down plate spaced from the wobble plate and comprising a plurality of retention fingers and wherein:

the pump includes a plurality of piston assemblies;

each piston assembly includes a fill opening; and a different retention finger extends into the fill opening of each piston assembly.

3. The pump of claim 2 including an axis of rotation and wherein:

the wobble plate has a surface angular with respect to the axis of rotation; and the hold-down plate is supported on a pivot device permitting undulating movement of such hold-down plate, whereby the hold-down plate is maintained in a positional relationship with respect to the surface.

4. The pump of claim 3 wherein:

the pivot device includes a spherical guide member coupled to the hold-down plate; and the guide member is supported by a sleeve member for undulating movement of the guide member with respect to the sleeve member.

5. The pump of claim 4 wherein:

the wobble plate has a center of rotation coincident with the axis of rotation;

the sleeve member is mounted for axial movement with respect to the center of rotation; and the sleeve member is restrained by a mechanical stop at a position with respect to the center of rotation.

6. The pump of claim 5 wherein the mechanical stop is adjustable, thereby permitting adjustment of the position of the sleeve member with respect to the center of rotation.

7. The pump of claim 4 including a compression spring urging the sleeve member toward the wobble plate.

8. The pump of claim 2 including:

a bearing having (a) a spheroid member and (b) an outer race mounted on the spheroid member for undulating movement; and the hold-down plate is supported by the outer race.

9. The pump of claim 8 including a compression spring urging the bearing toward the wobble plate.

10. The pump of claim 1 wherein:

the piston assembly includes (a) a piston having a spheroid head and (b) a piston shoe contacting the wobble plate and having a spheroid cavity receiving the head, whereby the shoe is retained between the head and the wobble plate.

11. The pump of claim 1 wherein:

the piston includes a finger-contact portion; and the retention finger engages the finger-contact portion for retaining the assembly in contact with the wobble plate.

12. The pump of claim 9 wherein:

the piston includes an interior cavity and a proximal end; and the finger-contact portion includes a ball in the interior cavity at the proximal end.

* * * * *